US008616416B2

(12) United States Patent
Jordan

(10) Patent No.: US 8,616,416 B2
(45) Date of Patent: Dec. 31, 2013

(54) DELIVERY HEAD

(75) Inventor: Ralf Jordan, Dortmund (DE)

(73) Assignee: Aptar Dortmund GmbH, Dortmund (DE)

( * ) Notice: Subject to any disclaimer, the term of this patent is extended or adjusted under 35 U.S.C. 154(b) by 122 days.

(21) Appl. No.: 13/058,274

(22) PCT Filed: Aug. 11, 2009

(86) PCT No.: PCT/EP2009/005806

§ 371 (c)(1),
(2), (4) Date: May 2, 2011

(87) PCT Pub. No.: WO2010/017950

PCT Pub. Date: Feb. 18, 2010

(65) Prior Publication Data

US 2011/0309112 A1 Dec. 22, 2011

(30) Foreign Application Priority Data

Aug. 12, 2008 (DE) ..... 10 2008 038 654

(51) Int. Cl.

| | |
|---|---|
| ***B65D 83/00*** | (2006.01) |
| ***B67D 3/00*** | (2006.01) |
| ***B67D 7/06*** | (2010.01) |

(52) U.S. Cl.
USPC ..... 222/402.12; 222/402.13; 222/511; 222/517

(58) Field of Classification Search
USPC ..... 222/402.12, 402.13, 182, 517, 380, 222/556, 402.21, 511; 220/282, 283
See application file for complete search history.

(56) References Cited

U.S. PATENT DOCUMENTS

| | | | | |
|---|---|---|---|---|
| 1,881,488 | A | | 10/1932 | Gleason |
| 2,500,687 | A | | 3/1950 | Kamp et al. |
| 2,714,475 | A | | 8/1955 | Roehrich |
| 2,721,010 | A | | 10/1955 | Meshberg |
| 2,736,930 | A | | 3/1956 | Longley |
| 2,772,819 | A | * | 12/1956 | Poarch et al. ..... 222/402.11 |
| 2,812,884 | A | | 11/1957 | Ward |
| 2,837,249 | A | | 6/1958 | Meshberg |
| 2,884,164 | A | | 4/1959 | Kleid |

(Continued)

FOREIGN PATENT DOCUMENTS

| | | |
|---|---|---|
| DE | 2043415 | 9/1970 |
| DE | 2920497 | 11/1980 |

(Continued)

OTHER PUBLICATIONS

International Search Report prepared by the European Patent Office on Jan. 29, 2010 for International Application No. PCT/EP2009/005806.

(Continued)

*Primary Examiner* — Paul R Durand
*Assistant Examiner* — Vishal Pancholi
(74) *Attorney, Agent, or Firm* — Jason H. Vick; Sheridan Ross, PC

(57) ABSTRACT

A delivery head and a delivery device having a delivery head, wherein a pivotable actuating element is provided in order to open an outlet valve when the delivery head is actuated. The actuating element is provided with a valve element in order to forcibly open the outlet valve by pivoting the actuating element and/or to move the valve element on a circular path.

49 Claims, 6 Drawing Sheets

(56) References Cited

U.S. PATENT DOCUMENTS 2,980,301 A 4/1961 Gorter
3,018,928 A 1/1962 Meshberg
3,073,489 A 1/1963 Friedman
3,104,785 A 9/1963 Beard, Jr.
3,131,834 A 5/1964 Meshberg
3,154,224 A * 10/1964 Wakeman ..... 222/402.12
3,155,291 A * 11/1964 Wakeman ..... 222/402.12
3,162,333 A 12/1964 Davidson
3,258,369 A 6/1966 Blaich
3,286,885 A * 11/1966 Huling ..... 222/182
3,323,695 A * 6/1967 Monahon ..... 222/506
3,337,096 A * 8/1967 Brown ..... 222/380
3,385,482 A 5/1968 Frangos
3,507,586 A 4/1970 Gronemeyer et al.
3,511,418 A 5/1970 Venus, Jr.
3,542,253 A 11/1970 Weber et al.
3,608,830 A 9/1971 Ramella
3,642,179 A * 2/1972 Micallef ..... 222/402.12
3,672,543 A 6/1972 Roper et al.
3,698,961 A 10/1972 Niemann
3,705,667 A 12/1972 Blanie et al.
3,706,393 A 12/1972 Curtis et al.
3,726,442 A 4/1973 Davidson et al.
3,795,350 A 3/1974 Shay
3,796,356 A 3/1974 Venus, Jr.
3,918,615 A 11/1975 Morane
3,931,831 A 1/1976 French
3,961,725 A 6/1976 Clark
3,991,916 A 11/1976 Del Bon
4,035,303 A 7/1977 Ufferfilge
4,099,651 A 7/1978 Von Winckelmann
4,222,501 A 9/1980 Hammett et al.
4,304,749 A 12/1981 Bauer
4,352,443 A 10/1982 Libit
4,387,833 A 6/1983 Venus, Jr.
4,393,984 A 7/1983 Debard
4,416,602 A 11/1983 Neumeister
4,423,829 A 1/1984 Katz
4,458,832 A 7/1984 Corsette
4,493,444 A 1/1985 Del Bon et al.
4,506,808 A * 3/1985 Goncalves ..... 222/182
4,513,890 A * 4/1985 Goncalves ..... 222/153.06
4,564,130 A 1/1986 Eulenburg
4,830,229 A 5/1989 Ball
4,867,347 A 9/1989 Wass et al.
4,875,604 A 10/1989 Czech
4,892,231 A 1/1990 Ball
4,919,312 A 4/1990 Beard et al.
4,946,076 A * 8/1990 Hackmann et al. ..... 222/207
4,964,852 A 10/1990 Dunning et al.
4,969,577 A 11/1990 Werding
5,007,556 A 4/1991 Lover
5,007,596 A 4/1991 Iwahashi
5,096,098 A 3/1992 Garcia
5,139,201 A 8/1992 De Laforcade
5,197,637 A 3/1993 Naumann
5,221,724 A 6/1993 Lie et al.
5,244,128 A * 9/1993 De Laforcade ..... 222/402.13
5,271,432 A 12/1993 Gueret
5,273,191 A 12/1993 Meshberg
5,301,850 A 4/1994 Gueret
5,305,930 A 4/1994 De Laforcade
5,340,031 A 8/1994 Neuhaus et al.
5,360,145 A 11/1994 Gueret
5,413,250 A 5/1995 Gueret
5,454,488 A 10/1995 Geier
5,465,872 A 11/1995 Gueret
5,492,252 A 2/1996 Gueret
5,505,341 A 4/1996 Gueret
5,509,582 A 4/1996 Robbins, III
5,588,565 A 12/1996 Miller
5,622,284 A * 4/1997 Sawicki ..... 222/153.14
5,649,645 A * 7/1997 Demarest et al. ..... 222/153.07
5,687,884 A 11/1997 Bodin et al.
5,728,333 A 3/1998 Tabata et al.
5,732,855 A 3/1998 Van der Heijden
5,743,441 A 4/1998 Baudin et al.
5,769,283 A 6/1998 Owada et al.
5,857,224 A 1/1999 Oberg et al.
5,862,955 A 1/1999 Albini et al.
5,868,287 A 2/1999 Kurolkawa et al.
5,873,491 A 2/1999 Garcia et al.
5,875,936 A 3/1999 Turbett et al.
5,875,939 A 3/1999 Geier
5,881,929 A 3/1999 Coerver, Jr.
5,927,568 A 7/1999 De Nervo et al.
5,975,381 A 11/1999 Revenu
6,007,914 A 12/1999 Joseph et al.
6,083,450 A 7/2000 Safian
6,112,953 A 9/2000 Gueret
6,116,475 A 9/2000 Delage
6,126,044 A * 10/2000 Smith ..... 222/402.14
6,145,707 A 11/2000 Baudin
6,216,916 B1 4/2001 Maddox et al.
6,227,417 B1 5/2001 De LaForcade et al.
6,234,363 B1 5/2001 Stradella
6,298,960 B1 10/2001 Derr
6,322,542 B1 11/2001 Nilson et al.
6,328,920 B1 12/2001 Uchiyama et al.
6,352,184 B1 3/2002 Stern et al.
6,382,469 B1 5/2002 Carter et al.
6,405,898 B1 * 6/2002 O'Connor et al. ..... 222/108
6,589,216 B1 7/2003 Abbott et al.
6,622,893 B2 9/2003 Leone et al.
6,629,799 B2 10/2003 Flores, Jr.
6,756,004 B2 6/2004 Davis et al.
6,778,089 B2 8/2004 Yoakum
6,832,704 B2 12/2004 Smith
6,919,114 B1 7/2005 Darras et al.
6,966,465 B2 11/2005 Kang
7,040,514 B2 5/2006 Colan et al.
7,104,424 B2 9/2006 Kolanus
7,264,142 B2 9/2007 Py
7,464,839 B2 12/2008 Heukamp
7,523,845 B2 4/2009 Eberhardt
7,637,399 B2 12/2009 Marroncles et al.
7,748,647 B2 7/2010 Clerget et al.
7,780,045 B2 8/2010 Rossignol
7,854,355 B2 12/2010 Rossignol
7,934,667 B2 5/2011 Westrich
8,109,412 B2 2/2012 Decottignies et al.
2002/0037179 A1 3/2002 Suzuki et al.
2002/0051314 A1 5/2002 Hayashi
2002/0074355 A1 6/2002 Lewis et al.
2002/0190085 A1 12/2002 Stanford
2003/0071080 A1 4/2003 Yquel
2003/0071085 A1 4/2003 Lasserre et al.
2003/0230603 A1 12/2003 Smith
2005/0098584 A1 * 5/2005 Do Rosario ..... 222/321.7
2005/0115984 A1 6/2005 Pritchett et al.
2005/0155980 A1 7/2005 Neuhalfen
2006/0060618 A1 3/2006 Hoepner et al.
2006/0186139 A1 8/2006 Laidler et al.
2006/0231519 A1 10/2006 Py et al.
2007/0228082 A1 10/2007 Jasper et al.
2007/0272767 A1 11/2007 Niggeman
2008/0099514 A1 5/2008 Carter et al.
2008/0110941 A1 5/2008 Foster et al.
2008/0197152 A1 8/2008 Neuhaus et al.
2009/0166383 A1 7/2009 Canfield
2009/0212075 A1 8/2009 Neuhaus et al.
2009/0236373 A1 * 9/2009 Laib et al. ..... 222/484
2009/0294480 A1 12/2009 Canfield
2009/0314810 A1 12/2009 Neuhaus
2010/0012680 A1 1/2010 Canfield et al.
2010/0038385 A1 2/2010 Jasper
2010/0108722 A1 5/2010 Canfield et al.
2010/0147898 A1 6/2010 Blumenstein et al.
2010/0200616 A1 8/2010 Decottignies
2010/0206911 A1 8/2010 Bernhard
2010/0252577 A1 10/2010 Neuhaus et al.
2010/0308077 A1 12/2010 Sonntag
2012/0111898 A1 5/2012 Neuhaus
2013/0056500 A1 3/2013 Neuhaus

(56) References Cited

U.S. PATENT DOCUMENTS

FOREIGN PATENT DOCUMENTS

| | | |
|---|---|---|
| DE | 9307083 | 7/1993 |
| DE | 4210225 | 9/1993 |
| DE | 19851659 | 11/1998 |
| DE | 29820894 | 1/1999 |
| DE | 19744510 | 4/1999 |
| DE | 19832824 | 2/2000 |
| DE | 19950512 | 5/2001 |
| DE | 20203841 | 6/2002 |
| DE | 10308727 | 6/2004 |
| DE | 202004011219 | 11/2004 |
| DE | 202004011220 | 11/2004 |
| DE | 20200512684 | 11/2005 |
| DE | 10 2007 049614 | 9/2008 |
| EP | 0058700 | 9/1982 |
| EP | 0069738 | 1/1983 |
| EP | 0179538 | 4/1986 |
| EP | 0320510 | 6/1989 |
| EP | 0442858 | 8/1991 |
| EP | 0599301 | 6/1994 |
| EP | 0864371 | 9/1998 |
| EP | 0893356 | 1/1999 |
| EP | 0908395 | 4/1999 |
| EP | 0930102 | 7/1999 |
| EP | 1084669 | 3/2001 |
| EP | 0954485 | 1/2002 |
| EP | 1327478 | 7/2003 |
| EP | 1637232 | 3/2006 |
| FR | 1266391 | 7/1961 |
| FR | 2127774 | 10/1972 |
| FR | 2510069 | 1/1983 |
| FR | 2654079 | 11/1989 |
| FR | 2783667 | 3/2000 |
| FR | 2838108 | 10/2003 |
| GB | 1405546 | 8/1972 |
| GB | 1523732 | 9/1978 |
| GB | 2083142 | 3/1982 |
| GB | 2105729 | 3/1983 |
| GB | 2150226 | 6/1985 |
| GB | 2155435 | 9/1985 |
| GB | 2161222 | 1/1986 |
| JP | 07251884 | 3/1995 |
| JP | 09039467 | 2/1997 |
| WO | WO 96/16746 | 6/1996 |
| WO | WO 00/26007 | 5/2000 |
| WO | WO 00/44505 | 8/2000 |
| WO | WO 01/25116 | 4/2001 |
| WO | WO 02/48004 | 6/2002 |
| WO | WO 02/079679 | 10/2002 |
| WO | WO 2004/022143 | 3/2004 |
| WO | WO 2004/073871 | 9/2004 |
| WO | WO 2004/073877 | 9/2004 |
| WO | WO 2005/000731 | 1/2005 |
| WO | WO 2005/123542 | 12/2005 |
| WO | WO 2005/123543 | 12/2005 |
| WO | WO 2006/123168 | 11/2006 |
| WO | WO 2006/128574 | 12/2006 |
| WO | WO 2007/062824 | 6/2007 |
| WO | WO 2007/104561 | 9/2007 |
| WO | WO 2009/030393 | 3/2009 |

OTHER PUBLICATIONS

International Preliminary Report on Patentability for International (PCT) Patent Application No. PCT/EP2009/005806, issued Feb. 15, 2011, 7 pages.

U.S. Appl. No. 12/600,219, filed Mar. 13, 2010, Canfield et al.

U.S. Appl. No. 13/529,109, filed Jun. 21, 2012, Canfield.

Wacker Silicones, Geniomer® 200 Thermoplastic Silicone Elastomer, Jan. 10, 2005, XP002394023, retrieved from Internet address http://www.wacker.com/internet/webcache/en_US?PTM?TM?GENIOMER/GENIOMER_200_e.pdf on Aug. 8, 2006.

* cited by examiner

DELIVERY HEAD

CROSS REFERENCE TO RELATED APPLICATIONS

This application is a national stage application under 35 U.S.C. 371 of PCT Application No. PCT/EP 2009/005806 having an international filing date of 11 Aug. 2009, which designated the United States, which PCT application claimed the benefit of German Application No. 10 2008 038 654.5 filed 12 Aug. 2008, the entire disclosure of each of which is hereby incorporated herein by reference.

The present invention relates to a dispensing head for a preferably cosmetic product according to the preamble of claim 1 and to a dispensing device with a dispensing head according to the preamble of claim 20.

The present invention relates to a dispensing head that preferably is or can be mounted on a container or the dispensing valve thereof or on a manually actuated pump. The dispensing head is preferably used for the non-spraying delivery or dispensing of a preferably cosmetic product.

The term "product" is to be generally understood as including liquids and particularly suspensions and other fluids as well, optionally with gas phases. The product can be dispensed as a paste, stream or mist or in another manner, for example as a foam or gel.

Preferably, the dispensing head is used for a cosmetic product. The term "cosmetic product" is to be understood in a narrower sense as cosmetics, hairspray, hair lacquer, deodorant, shaving foam, color spray, sunscreen or skin care agent, and generally agents for beauty care or the like. Preferably, however, other body or hair care products are also included as well in a broader sense.

For example, the product can be cleaning agents or lubricants or other products, for example air fresheners, and particularly other technical liquids and fluids as well such as rust removers or the like. Nonetheless, for the sake of simplicity and due to the emphasized use, there is often only mention of cosmetic product in the following.

In today's dispensing heads for the dispensing of particularly foaming or foamed products such as shaving foam, or in dispenser pumps, there is often the problem that the product continues to subsequently come out, particularly continues to foam or drip, after completion of the actual dispensing. This problem is particularly glaring in the case of shaving foam or the like but also occurs in non-foamed and non-foaming products and can lead, particularly, to undesired soiling of the dispensing heads.

U.S. Pat. No. 5,305,930 A discloses a dispensing head with an outlet channel that can be closed by an associated outlet valve. The outlet valve has a rod-shaped, linearly moveable valve element. Molded onto the valve element is an elastically deformable connecting section for coupling the valve element with an elastically deformable, bowl-like actuation element. The known dispensing head does not permit an optimally defined opening and closing of the outlet valve and is relatively expensive to manufacture.

It is the object of the present invention to provide a dispensing head and a dispensing device with a dispensing head, wherein a simple and cost-effective construction and/or an optimized, defined opening and closing of the outlet valve are made possible.

The above objective is achieved through a dispensing head according to claim 1 or through a dispensing device according to claim 20. Advantageous modifications are the object of the subclaims.

One idea of the present invention consists in the actuation element being swivelable relative to the outlet channel in order to force the outlet valve open and/or to move the valve element on a circular path. This enables a simple and compact construction and/or a very defined and optimized opening and closing of the outlet valve.

An additional idea of the present invention, which can also be implemented independently, provides for a guiding of the valve element by the actuation element particularly in an exclusive manner. This again enables a very simple and cost-effective construction and/or a defined opening and closing of the outlet valve.

According to another idea of the present invention that can also be implemented independently, the valve element is pre-tensioned in the closed position at least substantially only in the direction toward a swivel axis of the actuation element against an outlet opening of the dispensing head or outlet channel. Given a simple and cost-effective construction, this particularly enables a very defined and for the most part effortless closing of the outlet valve.

It should be noted that, in the present invention, the term "valve element" is to be understood as an element that closes an outlet opening when the outlet valve is closed and opens an outlet opening when the outlet valve is open.

The term "actuation element" is preferably to be understood as an element that can be actuated manually in a direct manner and/or must be actuated in order to actuate the dispensing head. Particularly, the actuation is performed by depressing a part of the actuation element.

Further advantages, features, characteristics and aspects of the present invention follow from the claims and the following description of preferred embodiments on the basis of the drawing.

In the partially not true-to-scale, only schematic figures, the same reference symbols are used for same or similar parts, with corresponding or comparable characteristics and advantages being achieved even if a repeated description is omitted.

Figure 1:
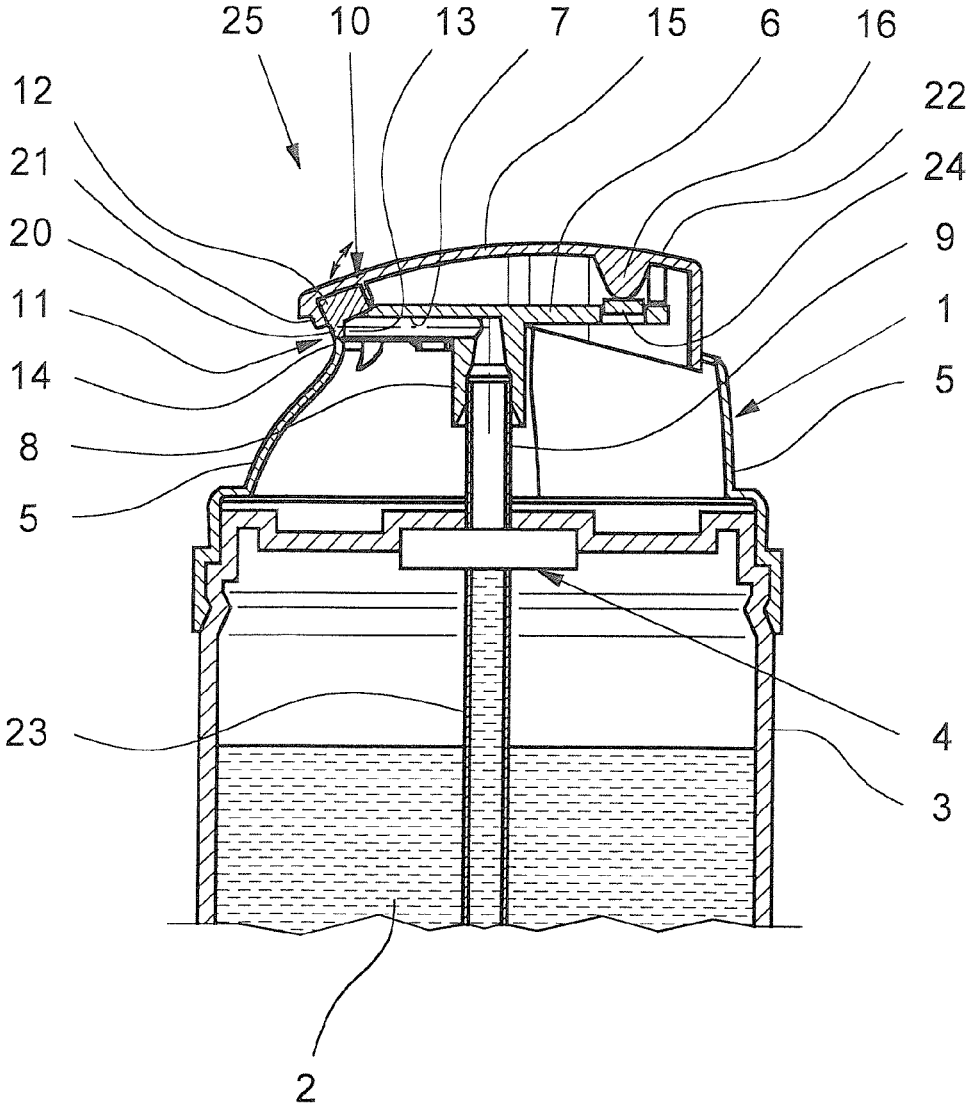
FIG. 1 shows a schematic section of a proposed dispensing device with a dispensing head according to a first embodiment.

In a schematic section, FIG. 1 shows a first embodiment of a proposed dispensing device 25 with a dispensing head 1 for dispensing a product 2 of the type mentioned at the outset.

The product 2 can be substantially more viscous than water or even pasty as desired. Particularly, it can form a foam or gel. The product 2 can also contain gas in liquid and/or another form.

In particular, the dispensing head 1 is designed for the non-spraying dispensing of the product 2. Particularly, the product 2 is dispensed as a foam, preferably as shaving foam or the like. For this purpose, the product 2 is particularly designed to be self-foaming and/or it is foamed up during dispensing.

In principle, however, the product 2 can also be dispensed in the non-foamed state or even be designed to be non-foaming. Moreover, it is also possible that the product 2 foams up very little, so that the foaming merely increases the volume somewhat but a liquid or pasty consistency is essentially maintained during dispensing.

It should be noted that, in principle, instead of the dispensing of the product 2 as a foam described for the sake of example, any other dispensing of the product 2—for example as a pasty mass, as a gel, as drops, as a stream or as a spray mist—is also worthy of consideration.

The dispensing head 1 is preferably provided or connected with a reservoir, particularly a container 3 of the dispensing device 25, for the product 2 to be delivered. The reservoir can form a part of the dispensing head 1 or can be connected thereto or vice versa.

In the depicted example, the reservoir is embodied as a preferably rigid container 3, particularly as a pressurized container. The container 3 is particularly oblong and/or cylindrical and/or rigid—especially preferably embodied as a metallic can—for the product 2.

The product 2 in the reservoir is either pressurizable or under pressure. In particular, the container 3 or the product 2 contains a suitable propellant, preferably a volatile and/or flammable propellant, compressed gas and/or carbon dioxide.

Especially preferably, the container 3 has on its front side a dispensing valve 4 to which the dispensing head 1 is or can be connected.

In the depicted example, the dispensing head 1 preferably has a housing part 5 that is or can be connected with the reservoir or container 3, especially preferably placed thereupon in a clamping or locking manner.

Moreover, the dispensing head 1 has a component 6 preferably placed into the housing part 5 and/or held or formed by same, which component 6 forms an outlet channel 7 and can be or is connected to the outlet valve 4. In the depicted example, the component 6 is provided with a corresponding connecting section 8 for particularly pluggable connection with the outlet valve 4 or a connection element 9 of the outlet valve 4.

In the depicted example, the housing part 5 and the component 6 are preferably embodied in a single piece, particularly with the housing part 5 maintaining the component 6 and hence the outlet channel 7 or connecting section 8 tiltable or depressable.

Preferably, the component 6 is tongue-like or arm-like and/or held on one side or on one end.

The connecting section 8 is preferably arranged in the area of the middle of the dispensing head 1 or of the free end of the component 6.

The component 6 or housing part 5 preferably forms a, for example, tiltable and/or tongue-like area or section with spring-like flexibility, so that it can be moved with the connecting section 8 toward the outlet valve 4 and, as a result, the outlet valve 4 (on the container side) can be opened.

In the depicted example, the dispensing head 1 has an outlet valve 10 that is particularly associated with the outlet channel 7 and/or a dispensing end 11 of the dispensing head 1.

Especially preferably, the outlet valve 10 has a valve element 12 for opening and closing the outlet valve 10 or the outlet channel 7. Especially preferably, no can and no other channel or the like is connected to the outlet valve 10 or its valve element 12 or to the dispensing end 11 or an outlet opening 13 of the outlet channel 7. Rather, they preferably open to the atmosphere. In this way, after leaving the outlet valve 10, the product 2 can preferably be removed directly and used by a user (not shown). In the depicted example, the valve element 12 covers the outlet opening 13 of the outlet channel 7 in the illustrated closed position preferably only from the outside.

The dispensing opening 13 of the outlet channel 7 preferably ends in or on a side wall 14 of the dispensing head 1 or housing part 5.

The dispensing head 1 has an actuation element 15 that is embodied as a separate part in the depicted example. However, other constructive solutions are possible, for example a one-piece design.

The opening of the outlet valve 4 is preferably done through the depression and/or tilting of the abovementioned area or component 6 with spring-like flexibility or of the connecting section 8 or of the actuation element 15. For example, the actuation element 15 can act on the component 6 for this purpose via a projection or actuating section 16.

Figure 2:
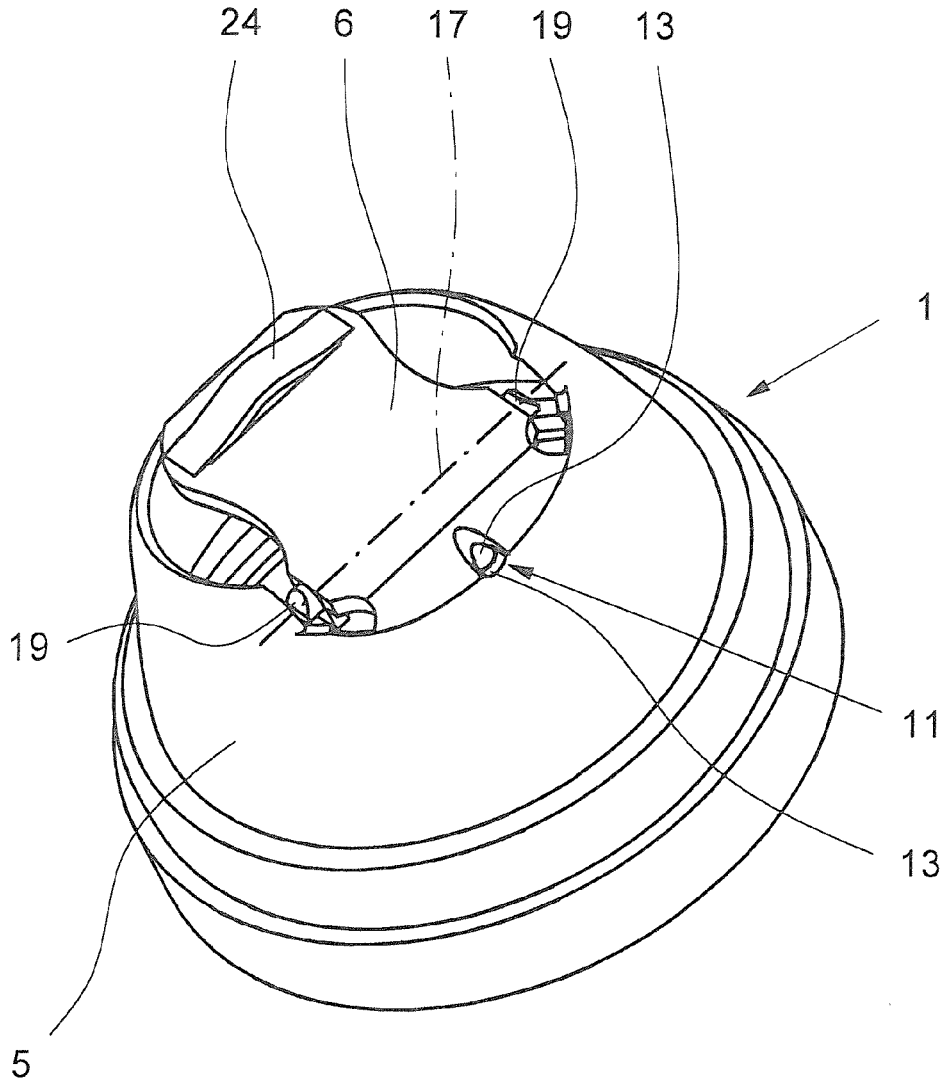
FIG. 2 shows a perspective view of a housing part of the dispensing head without actuation element.
Figure 3:
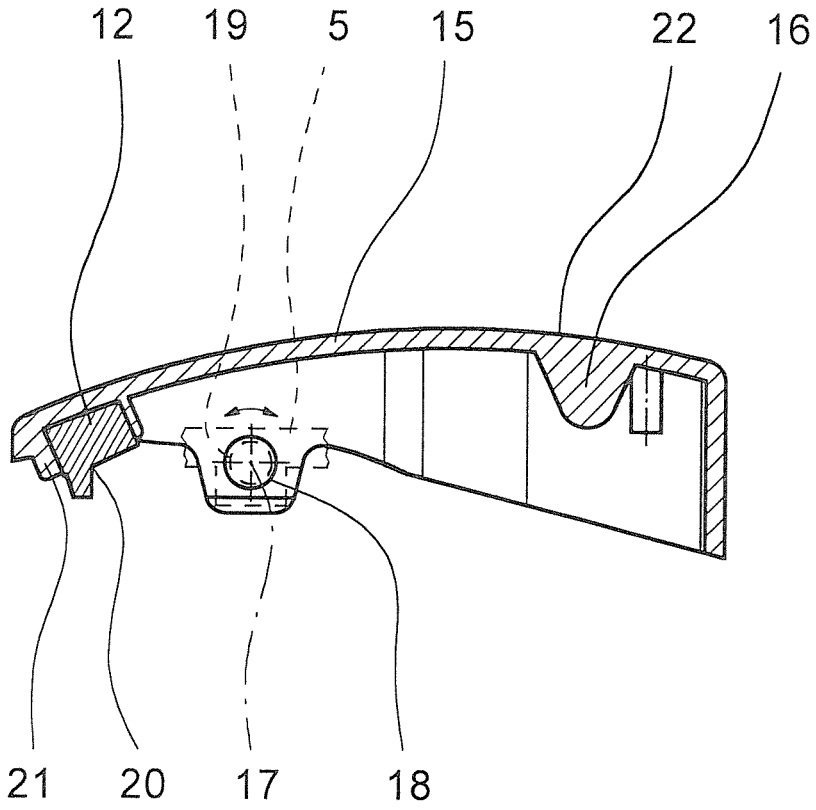
FIG. 3 shows a schematic section of an actuation element of the dispensing head.

The actuation element 15 is preferably swivelable or tiltable, particularly relative to the housing part 5, component 6 and/or outlet channel 7. In a perspective view, FIG. 2 shows the housing part 5 of the dispensing head 1 without actuation element 15. In an enlarged, schematic section, FIG. 3 shows the actuation element 15 without further components of the dispensing head 1.

In the depicted example, the actuation element 15 is embodied such that it can swivel about a swivel axis 17 and/or move in a rocker-like manner. For this purpose, the actuation element 15 is provided, for example, with mounting sections or bearing eyes 18 that can be supported, for example, by retention sections 19 of the housing part 5, as indicated in FIG. 3.

Preferably, the swivel axis lies essentially between the connecting section 8 on the one hand and the dispensing end 11 (outlet) or the outlet opening 13 on the other hand.

In principle, the swivel motion of the actuation element 15 can be superimposed onto another movement during actuation of the dispensing head 1 or direct manual actuation of the actuation element 15. Alternatively or in addition, the actuation element 15 can also be moved or actuated in a translational and/or rotational manner, for example vertically about an axis or at an angle to the swivel axis 17.

The valve element 12 is preferably guided or held exclusively by the actuation element 15.

Preferably, the valve element 12 is solidly connected with the actuation element 15.

In particular, the valve element 12 can only move together with the actuation element 15.

The valve element 12 is preferably made of an elastic material or plastic.

Preferably, the valve element 12 is injected against the actuation element 15 or vice versa. This is done particularly by means of so-called "bi-injection." By this method, a first component, such as the actuation element 15, is first injected into a mold and subsequently or (almost) simultaneously the second component, such as the valve element 12, is injected in the same injection mold directly against the first component. However, other manners of manufacture are also possible.

The actuation element 15 is preferably at least substantially rigid.

The actuation element 15 is preferably embodied in a single piece with the valve element 12 even if they are made of different materials and/or have different characteristics, such as being at least substantially rigid on the one hand and at least substantially elastic on the other hand.

Especially preferably, the valve element 12 is spherical and/or provided with a spherical closure section 20 as indicated in FIG. 1.

The valve element 12 closes the outlet opening 13 of the outlet channel 7 preferably only from the outside, particularly with the aforementioned closure section 20.

Especially preferably, the valve element 12 is arranged on a free end or edge 21 of the actuation element 15.

FIG. 1 shows the dispensing device 25 and the dispensing head 1 in the non-actuated state, which is to say with closed dispensing valve 4 and closed outlet valve 10.

The actuation element 15 is preferably designed for direct manual actuation and preferably has a grip or depression section 22 for this purpose. The grip section 22 is preferably arranged on the other side of the swivel axis 17 with respect to the valve element 12 or outlet valve 10.

Especially preferably, the distance of the grip section 22 from the swivel axis is greater than the distance of the valve element 12 from the swivel axis 17, preferably by a factor of 1.5 or more, particularly by a factor of about 2 in the depicted example. This leads to an advantageous transmission.

In the depicted closed state, the actuation element 15 is in the non-tilted or upper position (starting position), so that the valve element 12 holds the outlet valve 10 closed as shown in FIG. 1.

The actuation element 15 can be swiveled or tilted about the swivel axis 17 running preferably horizontally or, in the illustration according to FIGS. 1 and 3, perpendicular to the drawing plane. The swivel axis lies preferably between and/or approximately on a plane between the valve element 12 on the one hand and the actuating section 16 acting on the component 6 on the other hand. Accordingly, upon actuation or depression of the actuation element 15 from the position shown in FIG. 1, the actuating section 16 is moved downward and the valve element 12 upward or vice versa.

Through depression of the actuation element 15 or grip section 22 (on the right side in FIGS. 1 and 3), a swiveling of the actuation element 15 occurs and, consequently, the outlet valve 10 opens (here as a result of the lifting of the valve element 12 and release of the outlet opening 13) and, simultaneously or subsequently, the dispensing valve 4 opens. In particular, the component 6 is moved with the connecting section 8 downward or toward the dispensing valve 4 in order to open the latter through actuation of the connection element 9 or in another manner.

Upon actuation of the actuation element 15, the outlet valve 10 is forced open, particularly in a self-acting manner independently of the product pressure, since the valve element 12 is pushed down from the outlet opening 13, particularly at least substantially crossways or perpendicular to the main outlet direction. The valve element 12 is preferably guided exclusively by the actuation element 15. The valve element 12 is preferably moved only on one circular path as indicated in FIG. 1 by the double arrow.

When the dispensing valve 4 is open, the preferably pressurized product 2 in the reservoir or container 3 is then able to flow into the outlet channel 7, for example via ascending tube 23 (FIG. 1) and the opened dispensing valve 4. As needed, an initial foaming of the product 2 can then already occur in the outlet channel 7. As needed, a foaming device—not shown here—can also be provided (alternatively or in addition). For example, the product 2 or the foam can be foamed by a screen (not shown) and/or through the feeding of gas or air (alternatively or in addition).

The product 2 is able to escape to the outside or to the atmosphere through the opened outlet valve 10 and, especially preferably, foam up or foam up further or form a gel or another product or be delivered in liquid, pasty or another form.

Upon release of the actuation element 15, the dispensing valve 4 closes again, preferably in a self-acting manner. In the depicted example, the return to position of the component 6 or connecting section 8 preferably occurs exclusively as a result of spring forces of the elastic section and/or as a result of the dispensing valve 4.

In addition or alternatively, however, a return or closing spring or another constructive solution not shown can also be used.

As needed, the dispensing valve 4 can also be a dosing valve or other valve device, for example.

The dispensing of product or generation of foam definitively ends when the outlet valve 10 closes. The closed or closing outlet valve 10 prevents product 2 or foam or the like present in the outlet channel 7 from subsequently exiting or foaming out in an undesired manner.

Especially preferably, the actuation element 15 is pretensioned into its starting position or into the closing position closing the outlet valve 10. In the depicted example, a spring section 24 is provided for this purpose which is particularly molded on the component 6 in one piece or is formed by same. However, other constructive solutions are also possible.

The restorative force exerted on the actuation element 15 by the spring section 24 or another device is preferably smaller than the force required for the depression of the component 6 or connecting section 8 and, particularly, that required to open the dispensing valve 4. In this way, an arrangement can be achieved in which, upon actuation or depression of the actuation element 15 or grip section 22, the valve element 12 is first moved away, i.e., the outlet valve is opened, before the dispensing valve 4 opens.

One particular advantage of the outlet valve 10 is that, besides preventing the subsequent exiting of product 2, cleaning is made very simple for the user, since the outlet valve 10 preferably forms a clean or easy-to-clean dispensing end 11.

In the depicted example, the dispensing of product preferably occurs substantially crossways, particularly perpendicular, to the direction of depression or opening of the dispensing valve 4 and/or at least substantially horizontal or crossways to the longitudinal direction of the container 3.

It should be mentioned that, preferably, no other device shaping the product output such as a nozzle, a channel or the like is connected to the dispensing end 11. However, this does not rule out the possible provision of a bowl-like extension or recess in the housing or the like that leads to the dispensing end 11, for example.

In the depicted example, the actuation element 15 is preferably embodied as a separate part that is particularly placed, mounted, clamped or snapped on and is particularly mounted or held in a swiveling manner on the retention sections 19 (FIG. 2).

Preferably, the actuation element 15 is mounted or supported with its mounting sections or bearing eyes 18 or in another manner on both sides of the outlet valve 10 or valve element 12 and/or can be or is snapped onto the retention sections 19.

Other constructive solutions are also possible, however. In particular, the actuation element 15 can, in principle, also be mounted in a different way, be elastically deformable, and/or be molded onto the housing part 5 or component 6.

In the following, a second embodiment of the proposed dispensing head 1 is explained on the basis of the other figures, with the following description being limited to substantial differences or novel aspects. In particular, the foregoing remarks and explanations are applicable accordingly or in a supplemental manner.

Figure 4:
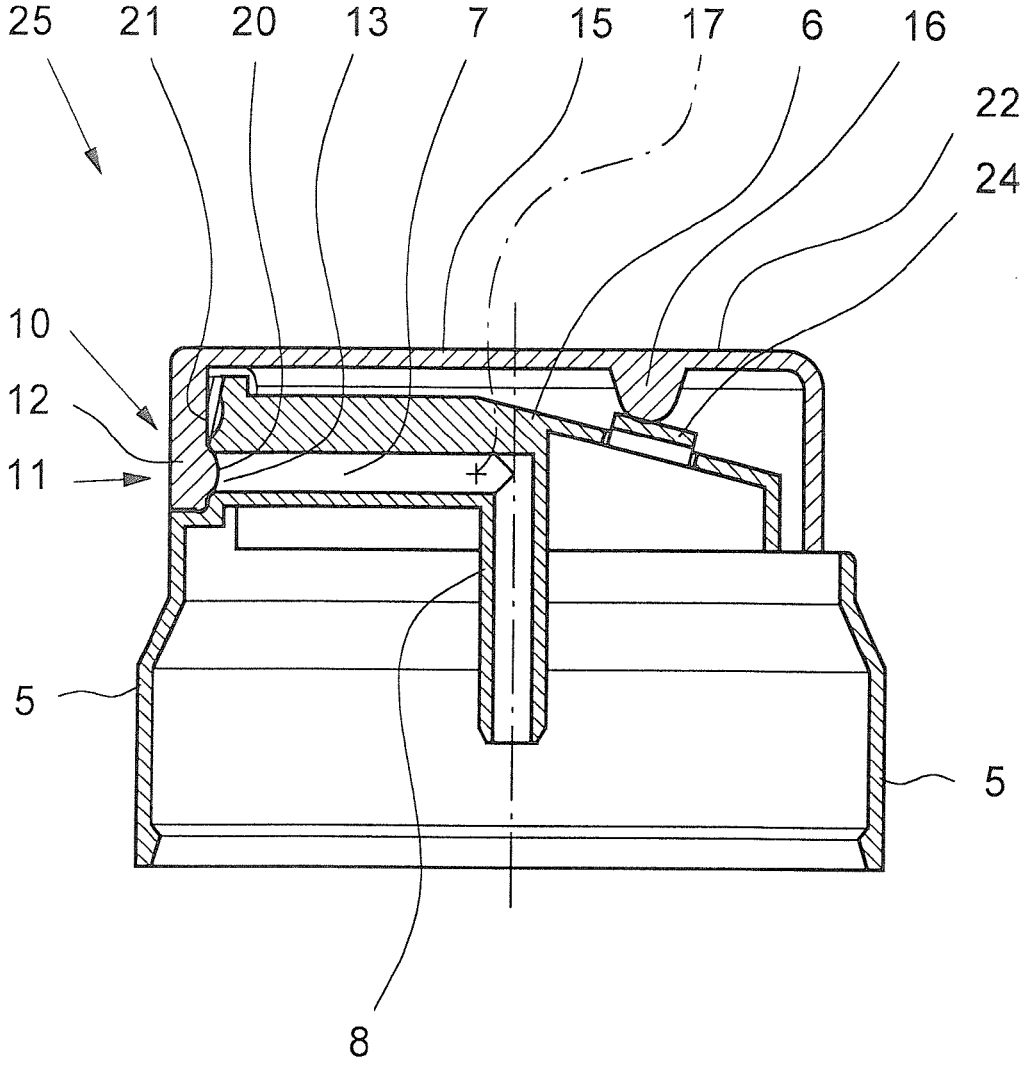
FIG. 4 shows a schematic section of a proposed dispensing head according to a second embodiment in the non-actuated state.
Figure 5:
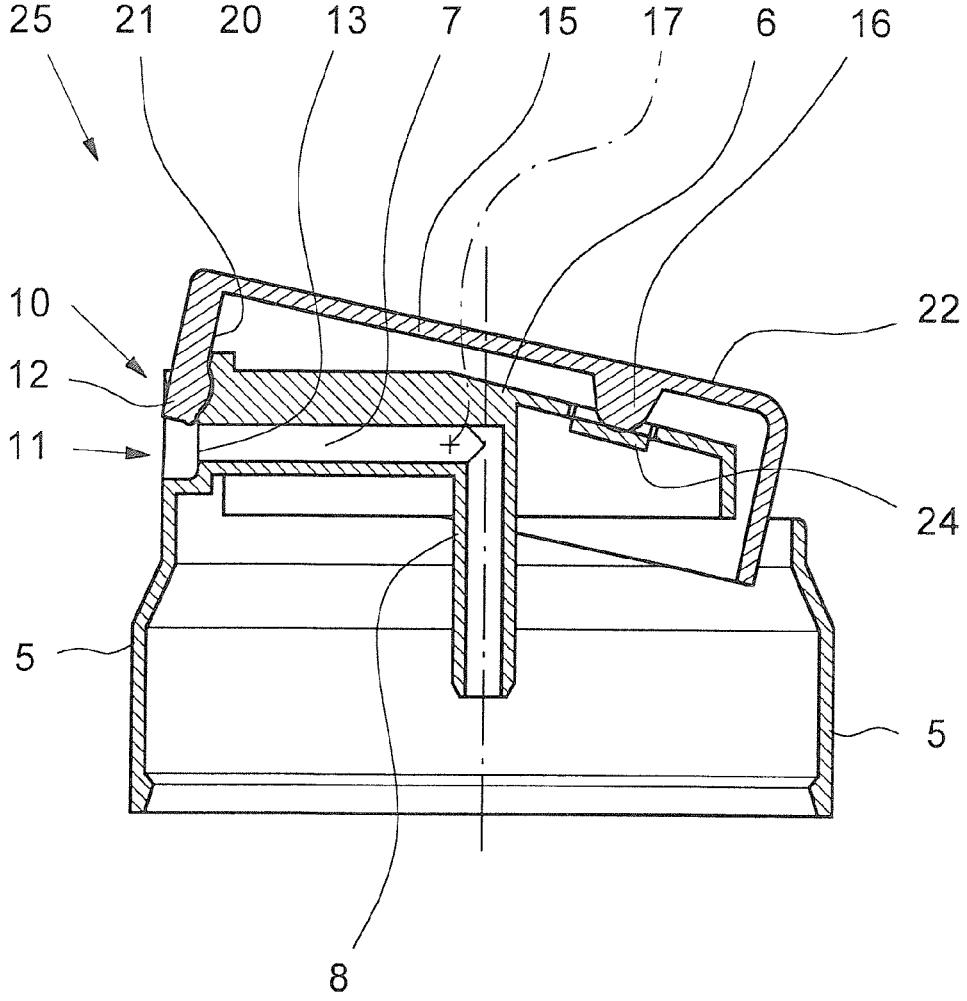
FIG. 5 shows a schematic section of the dispensing head according to FIG. 4 in the actuated state.
Figure 6:
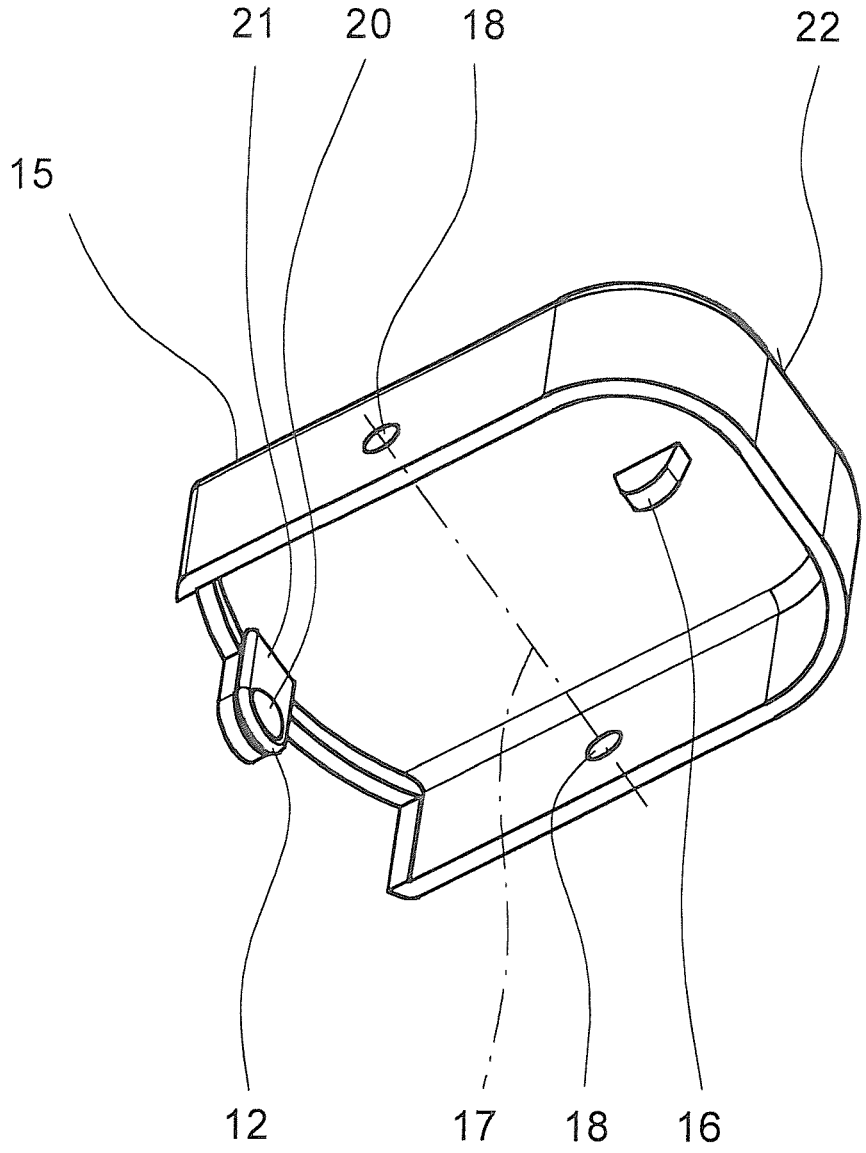
FIG. 6 shows a perspective view of a part of the actuation element of the dispensing head according to FIG. 4.

FIG. 4 shows a schematic section of the second embodiment of the proposed dispensing head 1 in the non-actuated state. FIG. 5 shows the dispensing head 1 in the actuated state, i.e., with opened outlet valve 10. In each of FIGS. 4 and 5, an upper part of the dispensing head 1 is shown. FIG. 6 shows a perspective view of a part of the actuation element 15 from below.

In the second embodiment, the valve element 12 is preferably arranged on an inner side of the edge 21 of the actuation element 15.

In the second embodiment, the closing section 20 of the valve element 12 is preferably arched or spherical and/or adapted such that it is able to extend at least partly into the dispensing opening 13 or the adjacent outlet channel 7 from the outlet side in the closed position.

Especially preferably, the actuation element 15 or outlet valve 10 is held in a locking manner in the closed position or non-actuated position. This can be achieved particularly by means of the aforementioned engaging of the valve element 12 or the connecting section 20 thereof into the outlet opening 13 or the outlet channel 7. However, other constructive solutions are also possible here.

In the second embodiment, the valve element 12 is preferably pretensioned in the closed position against the outlet opening 13 at least substantially axially or only toward the swivel axis 17. This enables a quasi effortless and/or defined closing of the outlet valve 10. In particular, the actuation of the actuation element 15 is decoupled from the closing force at least for the most part. This enables actuation that is as easy as possible with a good sealing effect and high closing force.

Especially preferably, the swivel axis 17 and the last section of the outlet channel 7 that extends toward the outlet opening 13 lie at least substantially on one plane. Alternatively or in addition, the swivel axis 17 preferably crosses a midperpendicular of the outlet opening 13 or passes close by it.

The following embodiments refer particularly to all embodiments as well as to the invention in general.

The housing part 5, component 6, valve element 12 are preferably injection-molded and/or made from plastic.

The actuation element 15 is made of a first material, particularly a relatively rigid plastic material. Preferably, a polyolefin, particularly PP (polypropylene) or PE (polyethylene) is used.

The valve element 12 is made of a second material. In particular, the second material is an elastomer and/or a thermoplast. Preferably, TPE (thermoplastic elastomer) or TPV or the like is used. Particularly, it is a flexible material. The second material is particularly flexible or softer than the first material. This is particularly desirable in the depicted embodiments, since the valve element 12 formed from it is to have a certain elastic deformability and/or flexibility in contrast to the actuation element 15.

Accordingly, the first material and the second material are preferably different, differing particularly with respect to their composition and/or characteristics. In principle, however, other constructions are also possible in which the same material can be used for the first material and the second material.

Preferably, a combination of materials is selected for the first material and the second material that is such that the two materials can preferably be joined solidly together directly through injection. Especially preferably, such a solid joining of the two materials can be achieved without pretreatment, adhesion promoters, processing or the like.

Especially preferably, the injection is performed by means of so-called "bi-injection," by which one material (the first material) is first injected into an injection mold and then the other material (the second material) is injected into the same injection mold against the previously injected material. In principle, however, it is also possible for the two materials to be injected almost simultaneously into the same injection mold.

By injecting the two materials against each other, the desired solid connection is achieved.

Preferably, no other measures are necessary for the joining of the two materials or components (here the actuation element 15 and the valve element 12) in order to achieve the desired strength, chemical bond, chemical resistance and/or seal. In principle, however, other measures such as pressing, clamping, welding or the like can also be used alternatively or in addition.

Especially preferably, the actuation element 15 forms an upper covering of the dispensing head 1 and/or it covers the component 6 and, optionally, the housing part 12 completely as well, at least to a substantial extent. Especially preferably, the actuation element 15 is embodied at least substantially in the manner of a cover or cap.

Especially preferably, the actuation element 15 extends with its edge 21 into the area of the side wall of the preferably at least substantially cylindrical housing part 5. However, other constructive solutions are also possible.

The proposed embodiments permit an optimal opening of the outlet valve 10 particularly over the full cross section of the outlet opening 13. In this way, an optimal outflow behavior and an optimal residual discharge can be achieved.

The various embodiments as well as individual features and constructive solutions of the embodiments can also be combined with each other as desired, or can also be used independently of each other and/or in other dispensing heads and dispensing devices.

LIST OF REFERENCE SYMBOLS

1 Dispensing head
2 Product
3 Container
4 Dispensing valve
5 Housing part
6 Component
7 Outlet channel
8 Connecting section
9 Connection element
10 Outlet valve
11 Dispensing end
12 Valve element
13 Outlet opening
14 Wall
15 Actuation element
16 Actuating section
17 Swivel axis
18 Bearing eye
19 Retention section
20 Closing section
21 Edge
22 Grip section
23 Ascending tube
24 Spring section
25 Dispensing device

The invention claimed is:

1. Dispensing head for a preferably cosmetic product, with an outlet channel, an associated outlet valve that has a moveable valve element and an actuation element for opening the outlet valve upon actuation of the dispensing head, wherein the dispensing head is embodied for connection with a container such that product is or can be dispensed from the container into the outlet channel upon actuation of the dispensing head, wherein the actuation element guides the valve element and can be swiveled relative to the outlet channel about a swivel axis upon actuation of the dispensing head in order to force the outlet valve open, wherein the valve element and the actuation element are embodied in a single piece, wherein the valve element has a closing section extending in the closed state into a dispensing opening of the outlet channel from an outlet side in order to close the dispensing opening from the environment, the outlet channel being perpendicular to a vertical axis of the container, and wherein the closing section extends into the outlet channel and points essentially to the swivel axis.

2. Dispensing head as set forth in claim 1, wherein the swivel movement of the actuation element is coupled with a tilting of the outlet channel upon actuation of the dispensing head, particularly for the opening of the outlet valve.

3. Dispensing head as set forth in claim 1, wherein the actuation element is pretensioned into the closed position, particularly by means of a spring section.

4. Dispensing head as set forth in claim 1, wherein the actuation element is embodied in the manner of a rocker.

5. Dispensing head as set forth in claim 1, wherein the actuation element forms a cover of the dispensing head or a flat or smooth covering of the dispensing head.

6. Dispensing head as set forth in claim 1, wherein the dispensing head has a housing part that one or more of:

bears the outlet channel, and is cylindrical, and wherein the actuation element at least in part covers the housing part.

7. Dispensing head as set forth in claim 1, wherein the actuation element completely covers a component of the dispensing head forming the outlet channel on the upper side of the dispensing head.

8. Dispensing head as set forth claim 1, wherein the actuation element is designed for direct manual actuation and is provided with a grip or depression section particularly for this purpose.

9. Dispensing head as set forth in claim 1, wherein the valve element is made of an elastic material.

10. Dispensing head as set forth in claim 1, wherein the valve element is injected against the actuation element.

11. Dispensing head as set forth in claim 1, wherein the outlet valve or the outlet opening opens directly into the atmosphere.

12. Dispensing head as set forth in claim 1, wherein the dispensing head is designed for the non-spraying and/or foaming delivery of the product.

13. Dispensing head as set forth in claim 1, wherein the dispensing head is designed for the delivery of foam or gel.

14. Dispensing device with a container that has a dispensing valve for dispensing a pressurized product from the container and with a dispensing head mounted on the container, wherein the dispensing head comprises a housing part, an outlet channel, an associated outlet valve having a moveable valve element, an actuation element for opening the outlet valve upon actuation of the dispensing head, and a component forming the outlet channel and being a part separate from the actuation element wherein the dispensing head is connected with the container such that the product can be dispensed from the container via a dispensing valve of the container into the outlet channel upon actuation of the dispensing head, wherein the actuation element guides the valve element and can be swiveled relative to the outlet channel and the component about a swivel axis upon actuation of the dispensing head in order to force the outlet valve open and to open the dispensing valve by depressing the component, wherein the housing part is connectable to the container, and wherein the housing part holds the component tiltable or depressible.

15. Dispensing device as set forth in claim 14, wherein the swivel movement of the actuation element is coupled with a tilting of the outlet channel upon actuation of the dispensing head for opening of the dispensing valve.

16. Dispensing device as set forth in claim 14, wherein the actuation element is pretensioned into the closed position by a spring section.

17. Dispensing device as set forth in claim 14, wherein the actuation element is a rocker.

18. Dispensing device as set forth in claim 14, wherein the actuation element forms a cover of the dispensing head or a flat or smooth covering of the dispensing head.

19. Dispensing device as set forth in claim 14, wherein the dispensing head has a housing part that one or more of:

bears the outlet channel, and is cylindrical, and wherein the actuation element at least in part covers the housing part.

20. Dispensing device as set forth in claim 14, wherein the actuation element completely covers a component of the dispensing head forming the outlet channel on the upper side of the dispensing head.

21. Dispensing device as set forth claim 14, wherein the actuation element is designed for direct manual actuation and is provided with a grip or depression section particularly for this purpose.

22. Dispensing device as set forth in claim 14, wherein the actuation element is one or more of:

rigid, and embodied in a single piece together with the valve element.

23. Dispensing device as set forth in claim 14, wherein the valve element is solidly joined with the actuation element.

24. Dispensing device as set forth in claim 14, wherein the valve element is held only by the actuation element.

25. Dispensing device as set forth in claim 14, wherein the valve element:

can only be moved together with the actuation element, can only be moved by the actuation element alone, or is forced by the actuation element.

26. Dispensing device as set forth in claim 14, wherein the valve element is made of an elastic material.

27. Dispensing device as set forth in claim 14, wherein the valve element is injected against the actuation element.

28. Dispensing device as set forth in claim 14, wherein the valve element seals the outlet channel in the manner of a spherical bush.

29. Dispensing device as set forth in claim 14, wherein the valve element only seals the outlet opening of the outlet channel opening directly into the atmosphere in the closed position from the outside.

30. Dispensing device as set forth in claim 14, wherein the outlet valve or the outlet opening opens directly into the atmosphere.

31. Dispensing device as set forth in claim 14, wherein the dispensing head is designed for the non-spraying and/or foaming delivery of the product.

32. Dispensing device as set forth in claim 14, wherein the dispensing head is designed for the delivery of foam or gel.

33. Dispensing head for a cosmetic product, with an outlet channel, an associated outlet valve that has a moveable valve element and an actuation element for opening the outlet valve upon actuation of the dispensing head, wherein the dispensing head for connection with the container is configured such that a product is or can be dispensed from the container, via a dispensing valve of the container into the outlet channel upon actuation of the dispensing head, wherein the actuation element guides the valve element and can be swiveled relative to the outlet channel about a swivel axis upon actuation of the dispensing head in order to force the outlet valve open wherein the valve element and the actuation element are embodied in a single piece, wherein the valve element is made of a first material, wherein the actuation element is made of a second, different material, and wherein the second material is a polyolefin and the first material is a thermoplastic elastomer, and the valve element extends into the outlet channel, the outlet channel being perpendicular to a vertical axis of the dispensing head.

34. Dispensing head as set forth in claim 33, wherein the valve element is made of an elastic material.

35. Dispensing head as set forth in claim 33, wherein the valve element is injected against the actuation element.

36. Dispensing head as set forth in claim 33, wherein the actuation element is made of a rigid material.

37. Dispensing head as set forth in claim 33, wherein the dispensing head comprises a component forming the outlet channel.

38. Dispensing head as set forth in claim 33, wherein the component is connectable to the dispensing valve of a container.

39. Dispensing head as set forth in claim 1, wherein the closing section is arched or spherical.

40. Dispensing head as set forth in claim 1, wherein the actuation element is made of a rigid material.

41. Dispensing head as set forth in claim 1, wherein the dispensing head comprises a component forming the outlet channel.

42. Dispensing head as set forth in claim 41, wherein the component is connectable to the dispensing valve of a container.

43. Dispensing head as set forth in claim 41, wherein the component is downwards pushable by the actuation element.

44. Dispensing device as set forth in claim 14, wherein the component is placed into the housing part.

45. Dispensing device as set forth in claim 14, wherein the component is formed by the housing part.

46. Dispensing device as set forth in claim 14, wherein the component is tongue-like or arm like.

47. Dispensing device as set forth in claim 14, wherein the component comprises a connecting section for pluggable connection with the container side outlet valve.

48. Dispensing device as set forth in claim 14, wherein the swivel axis lies between the connecting section and the dispensing end outlet or the outlet opening.

49. Dispensing head as set forth in claim 33, wherein the valve element and the actuation element are formed in the same tool by bi-injection.

* * * * *